US008692732B2

(12) United States Patent
Kwan et al.

(10) Patent No.: US 8,692,732 B2
(45) **Date of Patent: *Apr. 8, 2014**

(54) ANTENNA WITH MULTIPLE FOLDS

(75) Inventors: Philip Pak-Lin Kwan, Beaverton, OR (US); Paul Beard, Milpitas, CA (US)

(73) Assignee: Purlieu Wireless Ltd. LLC, Dover, DE (US)

( * ) Notice: Subject to any disclaimer, the term of this patent is extended or adjusted under 35 U.S.C. 154(b) by 246 days.

This patent is subject to a terminal disclaimer.

(21) Appl. No.: 13/100,177

(22) Filed: May 3, 2011

(65) Prior Publication Data

US 2011/0316756 A1 Dec. 29, 2011

Related U.S. Application Data

(63) Continuation of application No. 11/048,999, filed on Feb. 1, 2005, now Pat. No. 7,936,318.

(51) Int. Cl.
*H01Q 1/48* (2006.01)
*H01Q 9/04* (2006.01)

(52) U.S. Cl.
USPC ..... 343/845; 343/700 MS

(58) Field of Classification Search
USPC ..... 345/700 MS, 702, 895, 803, 804; 343/700 MS, 702, 895, 803, 804
See application file for complete search history.

(56) References Cited

U.S. PATENT DOCUMENTS 5,604,505 A 2/1997 Matterer
5,668,560 A 9/1997 Evans et al.
5,926,139 A 7/1999 Korisch
5,929,825 A * 7/1999 Niu et al. ..... 343/895
5,966,097 A 10/1999 Fukasawa et al.
6,166,694 A 12/2000 Ying
6,353,443 B1 * 3/2002 Ying ..... 715/702
6,424,299 B1 7/2002 Cha
6,518,937 B2 2/2003 Fang
6,535,172 B2 3/2003 Hirabayashi
6,738,023 B2 5/2004 Scott et al.
6,894,647 B2 * 5/2005 Jenwatanavet ..... 343/700 MS
6,894,846 B1 5/2005 He
6,930,640 B2 * 8/2005 Chung et al. ..... 343/700 MS
7,068,230 B2 * 6/2006 Qi et al. ..... 343/702
7,088,299 B2 8/2006 Siegler et al.

(Continued)

FOREIGN PATENT DOCUMENTS

DE 10319093 B3 11/2004
EP 1291964 A1 3/2003

(Continued)

OTHER PUBLICATIONS

International Search Report, mailed Apr. 7, 2006, for related International Patent Application No. PCT/US06/03653, filed Feb. 1, 2006; 2 pages.

(Continued)

*Primary Examiner* — Minh D A
(74) *Attorney, Agent, or Firm* — Stolowitz Ford Cowger LLP

(57) ABSTRACT

An example antenna includes a first end portion, a second end portion, and an intermediate portion between the first end portion and the second end portion. The intermediate portion includes multiple folds. The second end portion includes a first conductor to couple with a communication interface of a communication module, and a second conductor to couple with a ground.

20 Claims, 6 Drawing Sheets

(56) References Cited

U.S. PATENT DOCUMENTS

| | | | | |
|---|---|---|---|---|
| 7,148,846 | B2 | 12/2006 | Qi et al. | |
| 7,180,465 | B2 | 2/2007 | Lynch et al. | |
| 7,319,432 | B2 | 1/2008 | Andersson | |
| 7,936,318 | B2 * | 5/2011 | Kwan et al. | 343/895 |
| 2001/0043159 | A1 | 11/2001 | Masuda et al. | |
| 2002/0024466 | A1 | 2/2002 | Masuda | |
| 2003/0016177 | A1 | 1/2003 | Deguchi et al. | |
| 2003/0025637 | A1 | 2/2003 | Mendolia et al. | |
| 2004/0051673 | A1 * | 3/2004 | Moren et al. | 343/702 |
| 2004/0070541 | A1 | 4/2004 | Andersson et al. | |
| 2004/0075613 | A1 | 4/2004 | Jarmuszewski et al. | |
| 2004/0080457 | A1 * | 4/2004 | Guo et al. | 343/700 MS |
| 2004/0145527 | A1 | 7/2004 | Mikkola | |
| 2004/0160367 | A1 * | 8/2004 | Mendolia et al. | 343/700 MS |
| 2004/0160369 | A1 * | 8/2004 | Wong et al. | 343/702 |
| 2006/0170598 | A1 | 8/2006 | Kwan et al. | |

FOREIGN PATENT DOCUMENTS

| | | | |
|---|---|---|---|
| EP | 1476919 | A1 | 8/2003 |
| JP | 05-22018 | | 1/1993 |
| JP | 05-259724 | | 10/1993 |
| WO | 2006084014 | A1 | 8/2006 |

OTHER PUBLICATIONS

International Preliminary Report on Patentability mailed Aug. 7, 2007, for related International Patent Application No. PCT/US06/03653, filed Feb. 1, 2006; 6 pages.

Supplementary European Search Report for related European Patent Application No. 06720133.5, filed Feb. 1, 2006; 3 pages.

Examination Report mailed Jul. 10, 2008 for related European Patent Application No. 06720133.5, filed Feb. 1, 2006; 4 pages.

Stolowitz Ford Cowger LLP, "Listing of Related Cases", Aug. 9, 2013, 1 page.

* cited by examiner

ANTENNA WITH MULTIPLE FOLDS

RELATED APPLICATIONS

This application is a continuation of U.S. Non-Provisional Application Ser. No. 11/048,999, filed Feb. 1, 2005, now U.S. Pat. No. 7,936,318, issued May 3, 2011, which is incorporated herein by reference in its entirety.

BACKGROUND

1. Technical Field

This disclosure relates to wireless devices, more particularly to antenna used in wireless devices.

2. Background

Wireless devices send and receive signals through an antenna. For transmission, the antenna converts electrical signals from a power amplifier to electro-magnetic fields and radiates those fields out in a desired manner. When receiving, the antenna receives radiated electro-magnetic fields and converts them back to electrical signal for interpretation and operation by the wireless device.

Many different types of antenna are being used in wireless applications. A common one is an inverted 'F' antenna. It has two 'fingers' that provide electrical connection to the wireless device, and a long, straight arm that typically parallels an edge of the printed circuit board upon which the wireless device is mounted. The inverted F antenna provides good electrical performance, but has a rather large physical size. Another option is an antenna that is shaped similar to a 'question mark,' but the physical size is comparable to the inverted F antenna.

Wireless devices, because of their freedom from cables and wires, are particularly suited for small, portable implementations. One of the main physical constraints on making the device smaller is the size of the antenna. However, smaller antennas need to be able to match the electrical performance of the larger antenna.

SUMMARY

One embodiment of the invention is a wireless device has a module with a communications port and an antenna electrically coupled to the communications port, the antenna having multiple folds.

Another embodiment of the invention is an antenna having a shunt stub connected to a ground plane and a radiating portion that has multiple folds, or wiggles, allowing good electrical performance to be achieved with a minimal size.

Another embodiment of the invention is a method of manufacturing an antenna with multiple folds.

BRIEF DESCRIPTION OF THE DRAWINGS

Embodiments of the invention may be best understood by reading the disclosure with reference to the drawings, wherein.

DETAILED DESCRIPTION OF THE EMBODIMENTS

Figure 1:
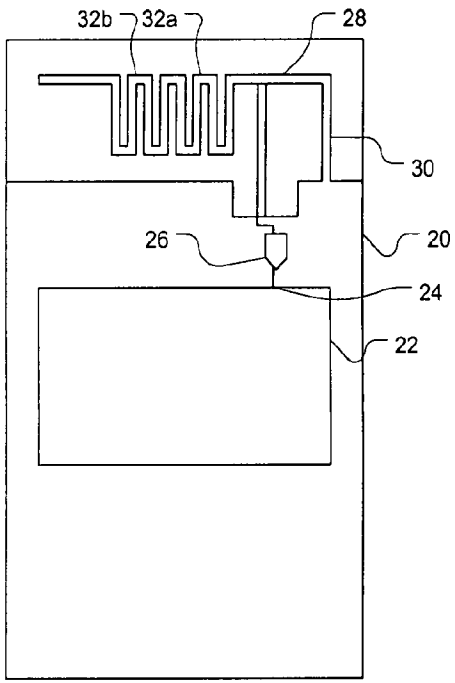
FIG. 1 shows an inverted F antenna.

An embodiment of an inverted F antenna is shown in FIG. 1. The substrate 10 has mounted on it a module 12. The substrate may be a printed circuit board, or equivalent, such as a layered ceramic substrate. The substrate provides electrical connections for the module to allow it to be connected to power, communications and other types of traces in the substrate. For example, this substrate may have an edge connector 15 that allows the substrate to be inserted into a slot on a larger substrate, such as a mother board. The mother board provides power, ground and signals to the individual conductors such as 17 of the edge connector. These conductors are then connected through traces on the substrate to the module.

The substrate may also provide a conductor 14 between a connector 16 for the inverted F antenna 18. The shunt stub 19 provides the connection between the radiating portion of the antenna and the module 12. The connector 16 would comprise a communications port that allows the module 12 to provide signals to be radiated out of the antennas, and to allow the module 12 to receive signals from the antenna for conversion and operation.

As can be seen in FIG. 1, the size of the substrate 10 is largely dependent upon the size of the inverted F antenna 18. This is due to the necessary size of the antenna to provide good electrical performance. As mentioned previously, it is generally desirable to reduce the size of wireless modules and the antenna is one of the main physical constraints on the size.

An alternative design is an antenna shaped much like a question mark, '?' However, the necessary size of this antenna is similar to that of the inverted F antenna, constraining the size of the unit to be of a larger-than-desirable size.

Figure 2:
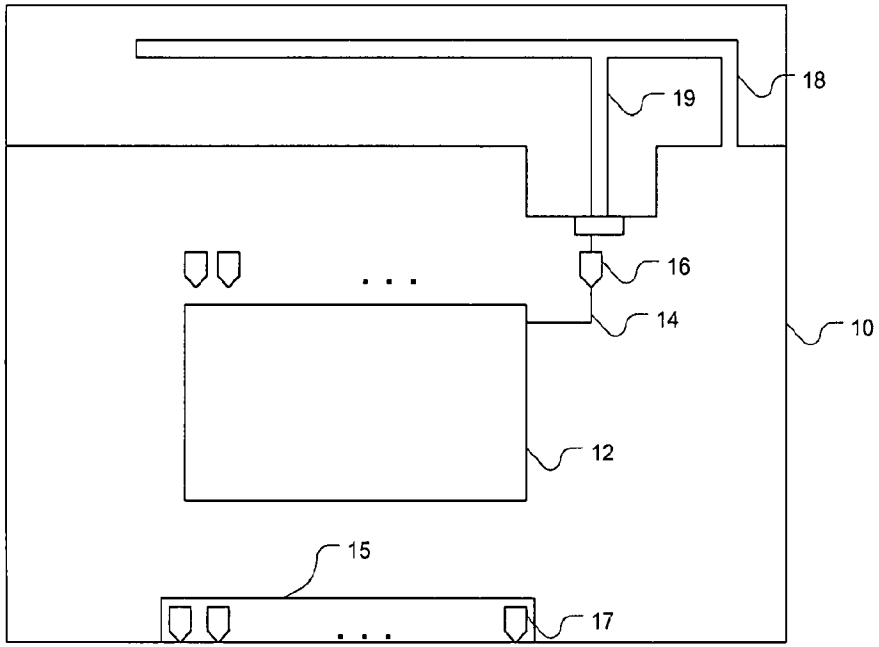
FIG. 2 shows an embodiment of a substrate having a module and an antenna having multiple folds.

In FIG. 2, an embodiment of an antenna having multiple folds is shown. This may be referred to as a 'wiggle' antenna. The actual sizes of the modules and antennas may vary, but the comparative sizes between them can be seen by comparing FIGS. 1 and 2. In this embodiment, the two substrates have a similar vertical extent, but the folded antenna substrate shown in FIG. 2 has less than half the horizontal extent of the inverted F antenna substrate.

In FIG. 2, the substrate 20 has a module 22 with connectors such as 26. A conductor 24 connects the module 22 to the connector 26, although the actual conductor may not be seen if it is buried in the layers of the substrate. The conductor 24 provides a communications port for the module 22. In one embodiment the module 22 is a Universal Serial Bus (USB) module that communicates with other devices using the USB communications protocol. The substrate 20 may or may not have other features, such as the edge connector of substrate 10 shown in FIG. 1.

The antenna 28 has multiple folds, such as 32*a* and 32*b*. The embodiment of FIG. 2 has a vertical shunt stub 30. The selection of a vertical shunt stub or a horizontal shunt stub is left up to the system designer, and the selection of a vertical shunt stub in this particular embodiment is merely for demonstration purposes only. Examples of horizontal and vertical shunt stub configurations are shown in FIGS. 3 and 4.

Figure 3:
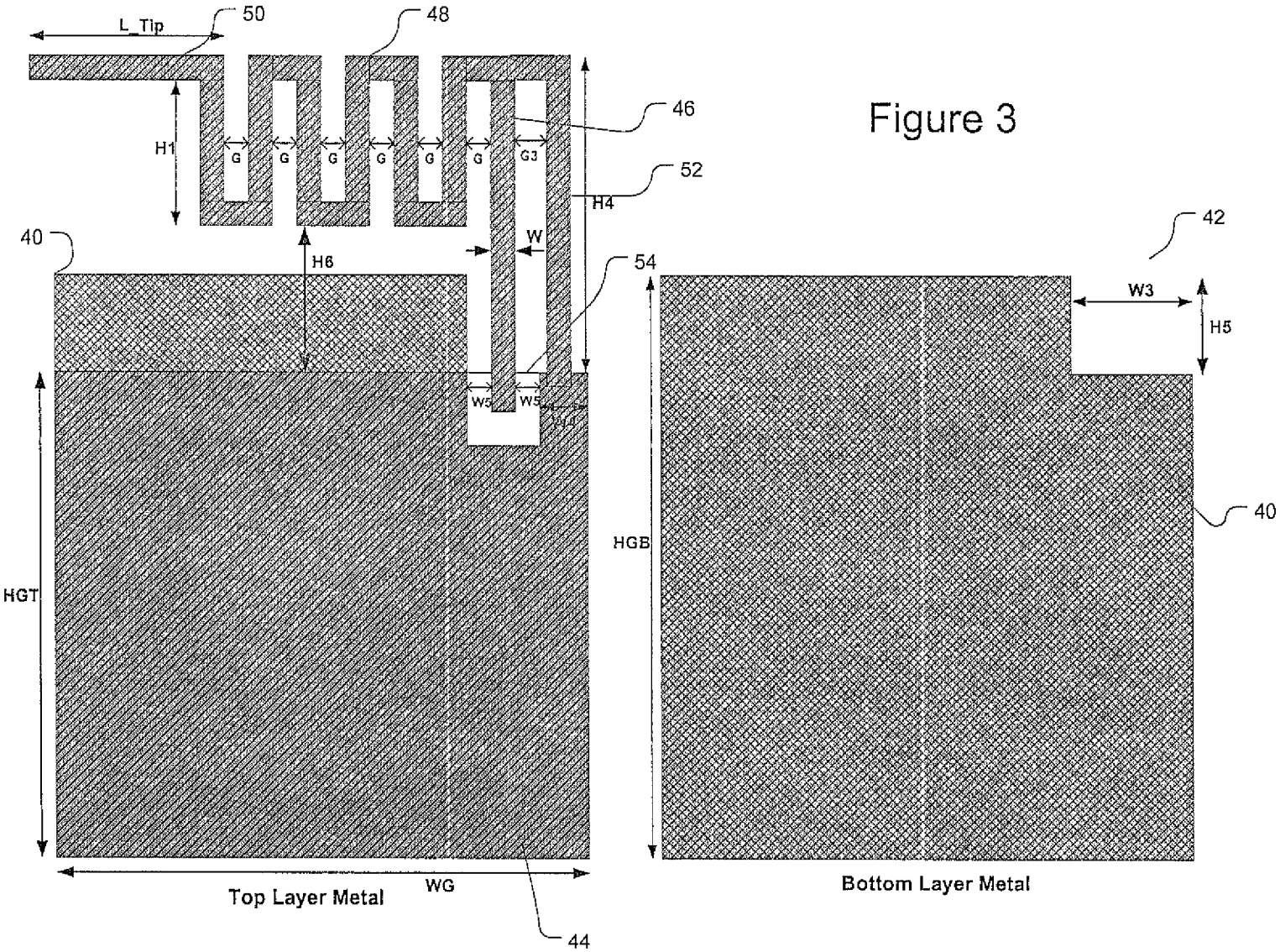
FIG. 3 shows an embodiment of an antenna having multiple folds and a vertical shunt stub.
Figure 4:
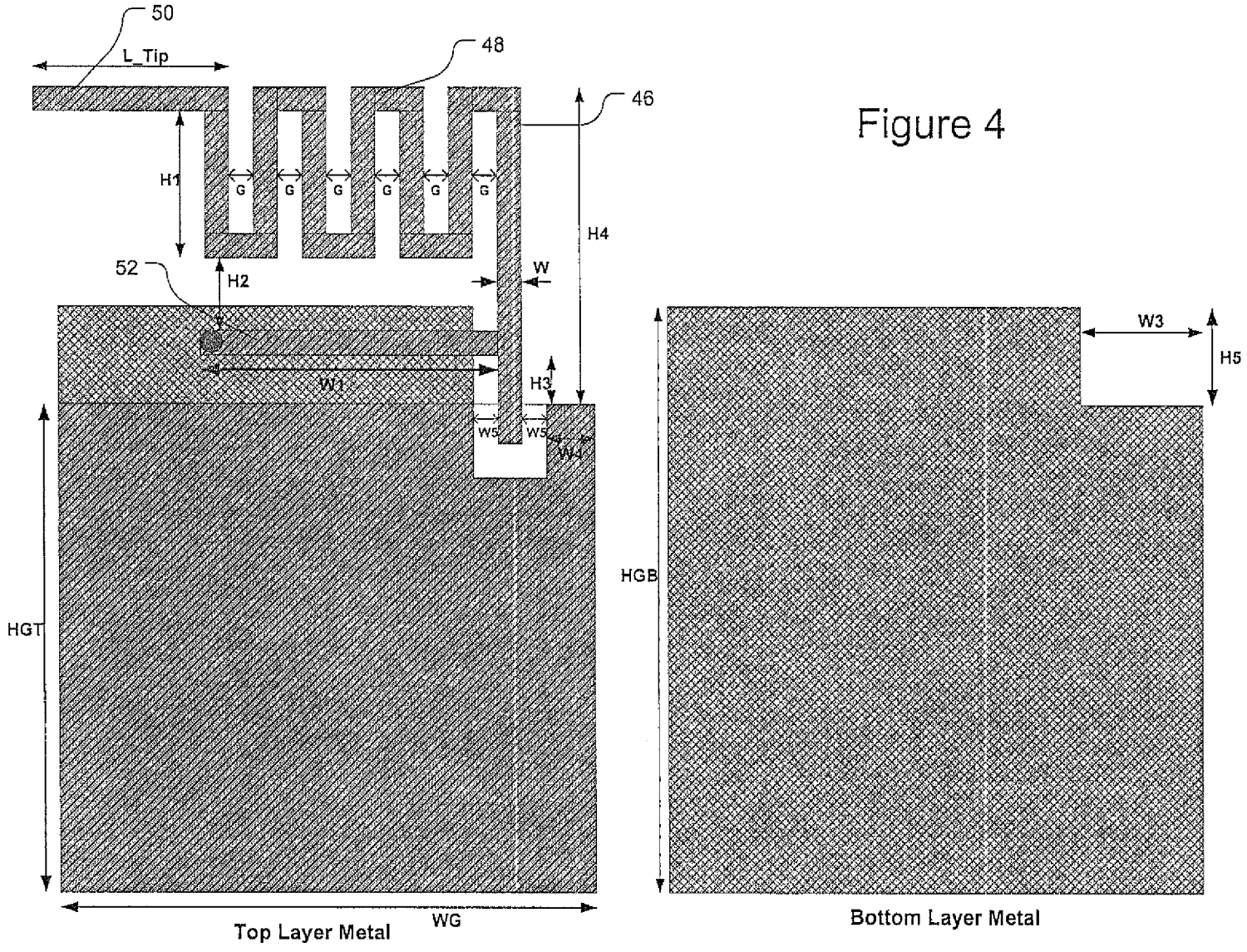
FIG. 4 shows an embodiment of an antenna having multiple folds and a horizontal shunt stub.

FIG. 3 shows a vertical shunt stub wiggle antenna. The antenna is manufactured out of a substrate that has a bottom layer metal 40 and a top layer metal 44. The bottom layer metal is shown on the right. It has a height HGB. A notch 42 having a height H5 and a width W3 is shown in this embodiment as being in the upper right hand corner of the bottom layer metal. This is merely for demonstrative purposes and the notch can be provided in any position in the bottom layer metal that will allow proper connection of the antenna.

The antenna in this embodiment is formed out of the top layer metal 44 as shown on the left. The top layer metal has a height HGT that may be less than that of the bottom layer metal height HGB. The radiating portion of the antenna has a connecting arm 46 that connects via a connector pad 54. The antenna has multiple folds such as 48, each spaced a distance G apart and having an interior height of H1, spaced from the bottom layer metal a distance H2.

The connecting arm and the width of the folds of the antenna are generally the same, shown here as width W. The exterior height of the antenna would therefore be the interior height H1 plus the width of the antenna itself at the top of the folds, W. The antenna has a tip 50, having a length L_tip. The individual selection of these dimensions is left up to the designer and the constraints of the module for which the antenna is being designed.

In this embodiment the shunt stub 52 is a vertical shunt stub. The shunt stub 52 is spaced a distance G3 from the first of the antenna folds. The shunt stub 52 will typically be as wide as the folds of the antenna, for ease of manufacturing. In this embodiment, it can be seen that the bottom of the folds of the antenna are spaced a distance H6 from the top layer of metal 44. For comparative purposes, the distance H6 in FIG. 3 is substantially equal to the distance H3+W+H2 of FIG. 4.

In addition to the radiating portion of the antenna, the antenna has a shunt stub 52. In one embodiment the radiating portion and the shunt stub are manufactured out of the same layer. No limitation that these structures be manufactured separately should be inferred. As can be seen in FIG. 3, the shunt stub 52 is connected to the bottom layer metal 40. This provides an extended ground plane for the antenna. The extended ground plane improves the antenna return loss and bandwidth control. Return loss is typically defined as the difference, usually expressed in decibels (dB), compared between the incident voltage or current on a transmission line and the reflected current or voltage as measured at a particular point. This will be discussed further with regard to FIG. 5. The position and size of the shunt stub also assists in achieving the desired resonant behavior.

Figure 5:
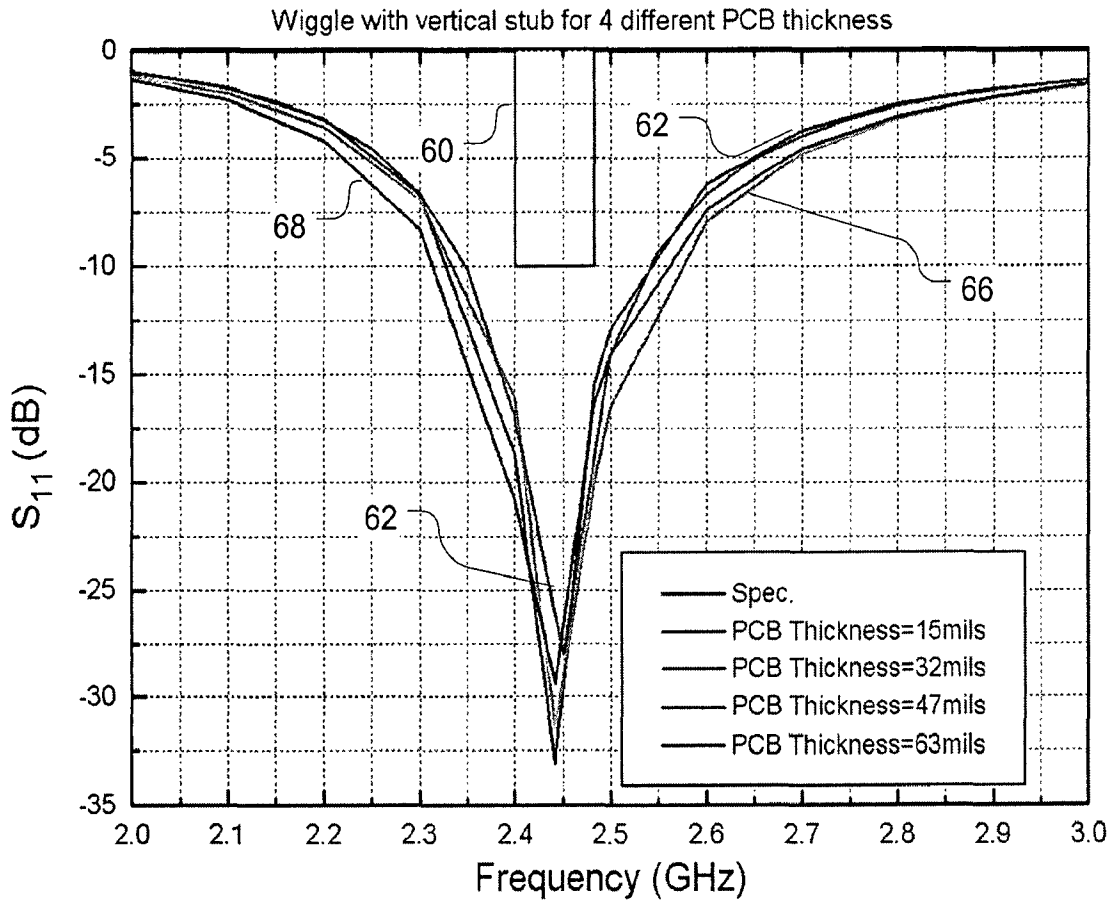
FIG. 5 shows a graph of antenna return loss versus frequency for different substrate thicknesses.

With regard to bandwidth control, the bandwidth control may be improved by the distance between the top layer and the bottom layer of metal in the substrate. This distance is referred to as the offset. There is an optimum offset for a given frequency and a given substrate thickness. The ground offset acts as a tuning element for the antenna, similar to a tuning capacitor. The performance of a wiggle antenna at different board thicknesses is shown in FIG. 5.

In FIG. 4, an embodiment of an antenna with a horizontal shunt stub is shown. In this embodiment, the connecting arm of the antenna 46 is connected to the pad 54 and the folds of the antenna 48 are spaced apart a distance G, as in the horizontal embodiment shown in FIG. 4. Shunt stub 52 is spaced above the top layer of metal 44 by a distance H3, and from the bottom of the folds of the antenna by a distance H2.

As discussed above with regard to FIG. 4, the use of a wiggle antenna reduces the size of the antenna, while still providing good return loss performance. FIG. 5 shows a graph of return loss versus frequency for four different thicknesses of substrates. In this graph, the substrates were printed circuit boards, but no limitation of the use of PCBs as the substrate is intended or implied.

On the graph, curve 60 is the performance specification for return loss. Curve 62 is the return loss performance for a wiggle antenna on a substrate thickness of 15 mils. It must be noted that the thickness of the substrate is the separation between the top layer metal and the bottom layer metal. Curve 64 is for a substrate that is 32 mils thick. Curve 66 is for a substrate that is 47 mils thick and curve 68 is for a substrate that is 63 mils thick. As can be seen by these results, the return loss is more than satisfactory for a wiggle antenna.

The wiggle antenna manufacture is not much more complicated than the manufacture of an inverted F antenna or similar construction, such as a question mark antenna. The process will be discussed relative to the bottom layer metal and the top layer metal shown in FIGS. 3 and 4.

Figure 6B:
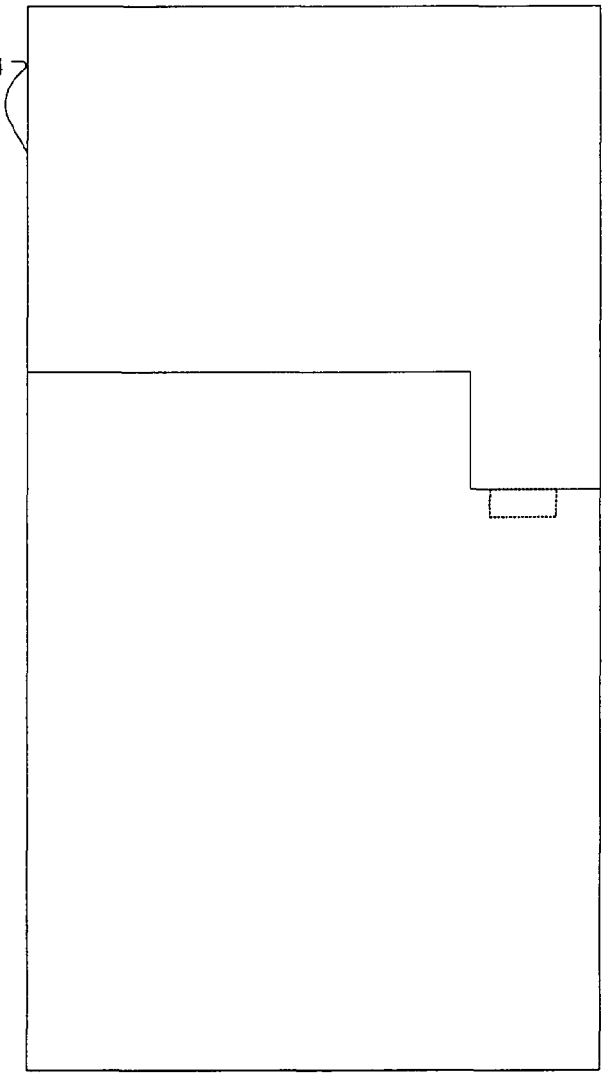
FIGS. 6*a*-6*d* show a flowchart of an embodiment of a method to manufacture an antenna having multiple folds on a substrate.
Figure 6A:
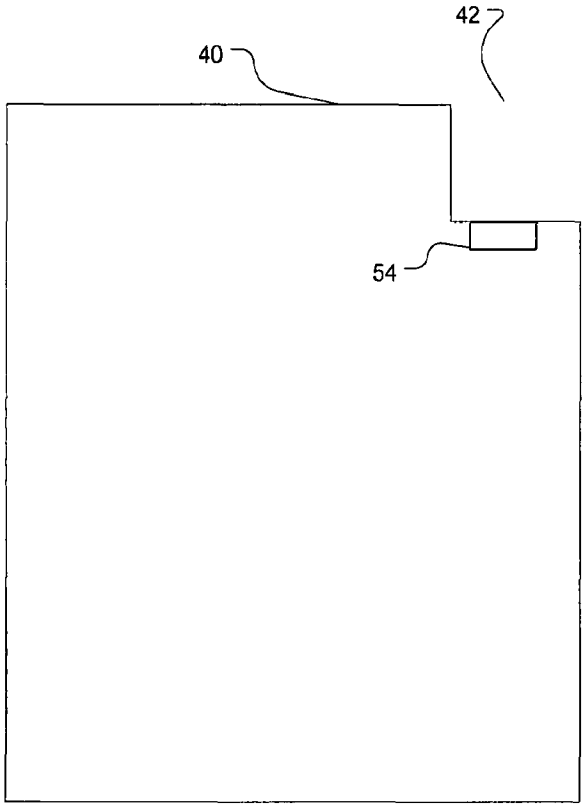

In FIG. 6*a*, bottom layer metal 40 is shown with the notch 42 in the upper left hand corner. As mentioned previously, the notch may be located at any position as desired by the system designer and for ease of manufacturing. In FIG. 6*a*, the contact pad 54 is provided, adjacent the notch 42.

When top metal layer 44 is formed or otherwise provided, it results in the structure shown in FIG. 6*b*. In one embodiment, where the antenna is formed out of the top layer metal, the top layer of metal may cover all the bottom layer of metal from this view. As discussed with regard to FIGS. 3 and 4, the dimensions of the folds of the antenna may be uniform. This allows the metal to be patterned and etched with fewer steps.

For example, assume a process where the metal is patterned with a UV-cured mask. The photoresist or other masking material is formed on the top layer of the metal. Using reticles to form the appropriate patterns, the photoresist is cured in a pattern such as the one shown in FIG. 6*c*. The uniformity of the structure dimensions allows fewer reticles to be used and easier step-and-repeat processes to form the folds of the antenna.

Figure 6D:
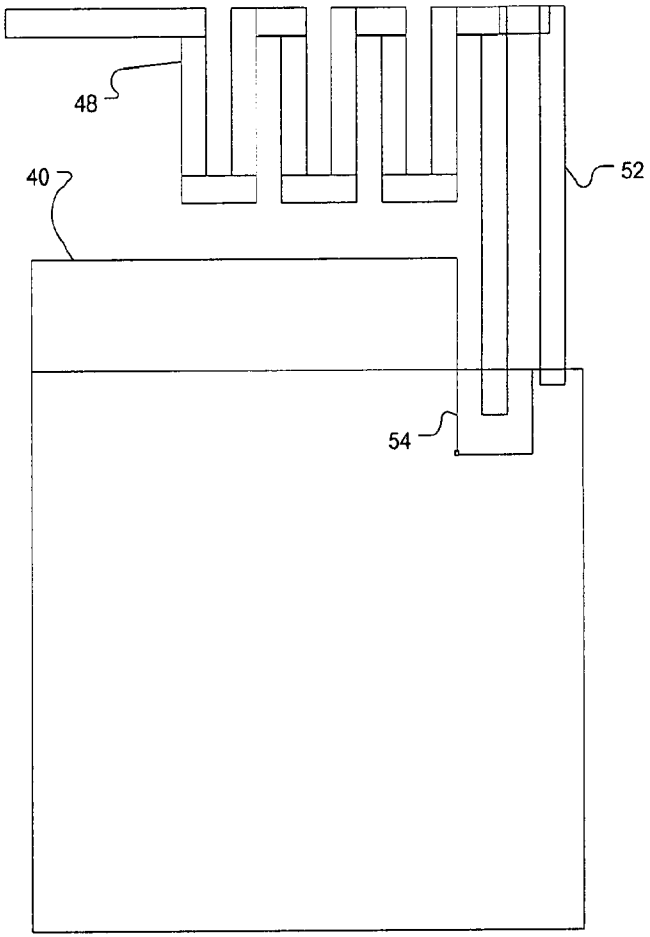
Figure 6C:
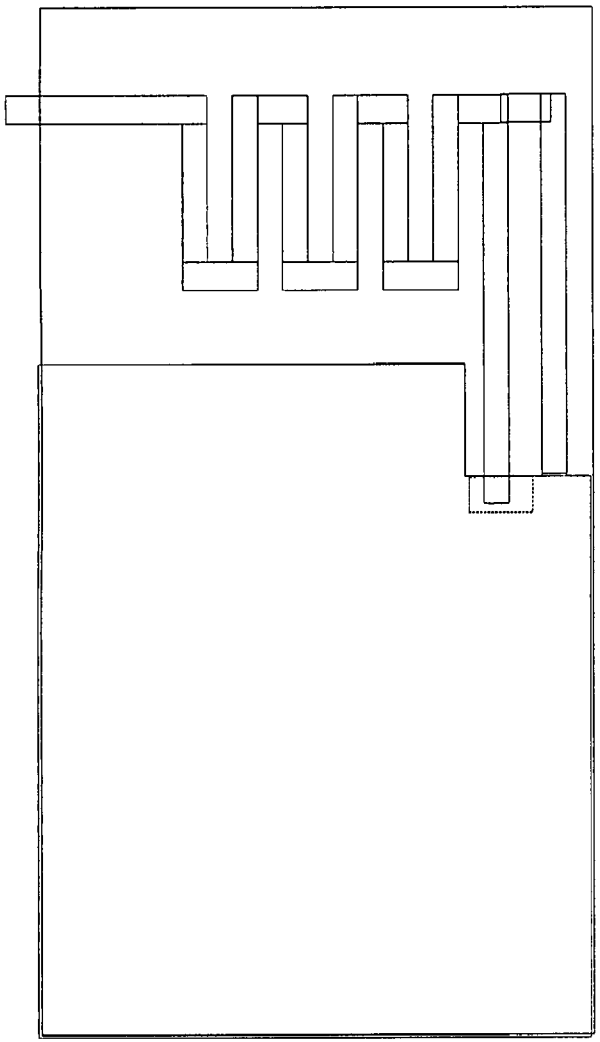

In FIG. 6*d*, the metal that is exposed is etched and the mask cleaned away, leaving the structures shown in FIG. 3. The antenna 48 is connected to the conductor pad 54, and the vertical stub 52 is connected to the bottom layer metal 40. The process for the vertical stub antenna would be very similar. As mentioned above, the discussion of the antenna may refer to a radiating portion and a shunt stub as though they were separate structures. However, in reality, these structures may be formed out of the same layer of metal at the same time.

In this embodiment, the antenna was formed in the top layer of metal and the bottom layer of metal is used for the ground plane. However, the reverse could also be implemented. The basic process would be to form a layer of metal on a substrate and then pattern and etch the metal to form the antenna with multiple folds. The metal layer from which the antenna is formed could be the top layer or the bottom layer.

For example, the metal layer formed on the substrate could be the bottom metal layer formed directly on the substrate. Alternatively, the metal layer could be the top metal layer formed on the substrate overlying other layers, including the bottom metal layer. It seems to result in a simpler manufacturing flow to use the top layer for the antenna and the bottom layer for the ground plane, but the process may be adjusted as necessary by the system designer.

The wiggle antenna has several advantages. The smaller size allows the overall unit to be smaller, as is desirable in wireless devices. The use of the extended ground plane on the front (top layer) or back (bottom layer) of the substrate provides improved return loss performance. Similarly, the extended ground plane allows better bandwidth control. The position and size of the shunt stub can be manipulated to allow for a particular resonant behavior.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

What is claimed is:

1. An antenna comprising:

a first end portion;

a second end portion; and an intermediate portion between the first end portion and the second end portion, wherein the intermediate portion includes multiple folds, and wherein the second end portion includes:

a first conductor configured to couple with a communication interface of a communication module; and a second conductor configured to couple with a ground, wherein the antenna is coupled to a first layer of a substrate and a second layer of the substrate, wherein the first conductor is configured to couple with the communication module through the first layer, and wherein the second conductor is configured to couple with the ground through the second layer.

2. The antenna of claim 1, wherein the first conductor includes a connector arm configured to communicate a signal with the communication module through the communication interface, and wherein the antenna is configured to receive the signal or transmit the signal, or a combination thereof.

3. The antenna of claim 1, wherein the second conductor comprises a shunt stub configured to match an impedance of the antenna with an impedance of the communication module.

4. The antenna of claim 1, wherein each fold, of the multiple folds, comprises a pattern including at least one vertical portion and at least one horizontal portion.

5. The antenna of claim 1, wherein a portion of the first conductor is parallel to a portion of the second conductor.

6. The antenna of claim 1, wherein a portion of the first conductor is perpendicular to a portion of the second conductor.

7. The antenna of claim 1, wherein the antenna is formed from a material of the first layer of the substrate and resides in the first layer of the substrate.

8. The antenna of claim 7, wherein the second layer comprises a ground plane.

9. The antenna of claim 1, wherein the communication module is a universal serial bus (USB) module configured to communicate a USB communication protocol through the antenna.

10. The antenna of claim 1, wherein the second conductor comprises a substantially linear shunt stub having a width that is approximately equal to a width of the antenna at the multiple folds.

11. A system comprising:

a substrate including a first layer and a second layer, wherein the second layer includes a ground plane;

a universal serial bus (USB) module residing on the substrate; and an antenna residing on the substrate, wherein the antenna is formed in the first layer of the substrate, and wherein the antenna includes:

a first end portion;

a second end portion; and an intermediate portion between the first end portion and the second end portion, wherein the intermediate portion includes multiple folds, and wherein the second end portion includes:

a connector arm configured to couple with a communication interface of the USB module, wherein the connector arm is configured to communicate a signal with the USB module through the communication interface; and a shunt stub configured to couple with the ground plane of the second layer.

12. The system of claim 11, wherein each fold, of the multiple folds, comprises a pattern including at least one vertical portion and at least one horizontal portion.

13. The system of claim 12, wherein at least two of the multiple folds have patterns with equal dimensions.

14. The system of claim 11, wherein a portion of the connector arm is parallel to a portion of the shunt stub.

15. The system of claim 11, wherein a portion of the connector arm is perpendicular to a portion of the shunt stub.

16. A method of manufacturing an antenna, the method comprising:

forming a first metal layer on a substrate as a ground plane;

patterning a second metal layer on the substrate to form an antenna having a shunt stub, a connecting arm, and a radiating portion with multiple folds;

forming a connection between the shunt stub and the ground plane, wherein the shunt stub is coupled between a first end of the radiating portion and the ground plane; and forming a communications port, wherein the connecting arm is coupled between the first end of the radiating portion and the communications port.

17. The method of claim 16, wherein the ground plane is an extended ground plane.

18. The method of claim 16, wherein the shunt stub comprises a width that is substantially equal to a width of the radiating portion of the antenna.

19. The method of claim 16, wherein the first metal layer is a bottom metal layer of a substrate and the second metal layer is a top metal layer of the substrate.

20. The method of claim 16, wherein the first metal layer is a top metal layer of a substrate and the second metal layer is a bottom metal layer of the substrate.

* * * * *